US007457202B2

(12) United States Patent
Takahashi

(10) Patent No.: US 7,457,202 B2
(45) Date of Patent: Nov. 25, 2008

(54) DATE DISPLAY MECHANISM AND TIMEPIECE POSSESSING DATE DISPLAY MECHANISM

(75) Inventor: Masaaki Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 155 days.

(21) Appl. No.: 11/155,957

(22) Filed: Jun. 17, 2005

(65) Prior Publication Data

US 2006/0002237 A1 Jan. 5, 2006

(30) Foreign Application Priority Data

Jun. 30, 2004 (JP) ..... 2004-194268

(51) Int. Cl.
*G04B 19/24* (2006.01)

(52) U.S. Cl. ..... 368/37; 368/28

(58) Field of Classification Search ..... 368/28–40
See application file for complete search history.

(56) References Cited

U.S. PATENT DOCUMENTS 6,081,483 A * 6/2000 Capt et al. ..... 368/28
6,574,167 B2 * 6/2003 Weissbach et al. ..... 368/35
7,102,962 B2 * 9/2006 Suzuki ..... 368/37
7,110,326 B2 * 9/2006 Besse ..... 368/37
2003/0193840 A1 * 10/2003 Huter ..... 368/37
2005/0169109 A1 * 8/2005 Watanabe ..... 368/37
2005/0174891 A1 * 8/2005 Besse ..... 368/37

FOREIGN PATENT DOCUMENTS

JP 3322678 5/2000

* cited by examiner

*Primary Examiner*—Vit W. Miska
*Assistant Examiner*—Sean Kayes
(74) *Attorney, Agent, or Firm*—Adams & Wilks

(57) ABSTRACT

A date display mechanism has a first driving wheel that rotationally drives a first date indicator for displaying places of units and a second driving wheel that rotationally drives a second date indicator for displaying places of tens. The second driving wheel causes the second driving wheel to rotate by one tooth when the date shifts from a 9th day to a l0th day, from a 19th day to a 20th day, and from a 29th day to a 30th day. A program wheel performs one revolution in 31 days and controls rotation of the first date indicator and the second date indicator so that from the 1st day to the 31st day, the first date indicator is rotated by one tooth every day, and so that when the date shifts from the 31st day to 1st day, the first date indicator is retained to a position of the 31st day and the second date indicator is rotated by one tooth to thereby cause the 1st day to be displayed by the date display window.

30 Claims, 13 Drawing Sheets

DATE DISPLAY MECHANISM AND TIMEPIECE POSSESSING DATE DISPLAY MECHANISM

BACKGROUND OF THE INVENTION

1. Field of the Invention

The present invention relates to a mechanical date display mechanism, and to a timepiece, such as a wristwatch or a small clock, having the date display mechanism.

2. Description of the Prior Art:

A mechanical date display mechanism that has been widely adopted for a wristwatch or a small clock is one which displays a date in a date display window by rotating a date display plate, in which numerals of 0 to 31 have been printed in an outer circumference part of a disk having the same size as a dial, by a predetermined angle once in one day. For this reason, since a numeral displaying the date becomes smaller than a numeral displaying a time, there is a problem that a date display is difficult to see. Whereupon, a date display mechanism in which the date display is made large has been developed, and has been adopted in a wristwatch available in the market.

In Japanese Patent No. 3322678 Gazette, there is disclosed a date display mechanism possessing a date display window in a 12 o'clock position. This date display mechanism is constituted by a unit's place wheel which is a disc-like gear wheel in whose outer circumference part there have been printed unit's place numerals, i.e., numerals of 0, 1, 2, 3, 4, 5, 6, 7, 8, 9, of date with an equal spacing, and which has been disposed such that the unit's place numeral of date appears in the date display window disposed in the 12 o'clock position, a ten's place wheel which is a disc-like gear wheel in whose outer circumference part there have been printed ten's place numerals, i.e., numerals of 0, 1, 2, 3, of date with an equal spacing, and which has been adapted such that the ten's place numeral appears in the date display window and has been disposed while being spaced such that its teeth don't mesh with the unit's place wheel, and a program wheel which is a doughnut-like gear wheel possessing 30 internal teeth for driving the unit's place wheel and 4 internal teeth for driving the ten's place wheel, and which is rotated by a date indicator driving wheel.

From 1st day to 31st day, the program wheel rotation-drives the unit's place wheel, and the unit's place wheel is unlocked by the 30 internal teeth for driving the unit's place wheel by for one tooth in one day. At the same time, the program wheel rotation-drives the ten's place wheel, and the ten's place wheel is unlocked by the 3 internal teeth for driving the ten's place wheel from the 1st to the 3rd by for one tooth in 10 days. Accordingly, the dates from 1st day to 31st day are displayed in date display window.

When it shifts from 31st day to 1st day, the unit's place wheel retains its settled position when it has shifted from 30th day to 31st day. This is achieved by not providing the internal tooth, of the program wheel, for driving the unit's place wheel between 1st day and 2nd day, but by making it into a skip interval. That is, even if the date indicator driving wheel unlocks the program wheel for one tooth, the unit's place wheel is retained in its settled position of 31st day. Accordingly, numeral of the unit's place appearing in the date display window is "1" intact. On the other hand, when it shifts from 31st day to 1st day, the ten's place wheel is unlocked for one tooth by the 4th internal tooth for driving the ten's place wheel. Accordingly, numeral of the ten's place appearing in the date display window is altered from "3" to "0". In this manner, if it shifts from 31st day to 1st day, date appearing in the date display window is altered from "31" to "01".

In short, the above-mentioned conventional date display mechanism is a date display mechanism constituted by the unit's place wheel formed monolithically with a unit's place display plate on which there have been printed numerals of the unit's place of date, the ten's place wheel formed monolithically with a ten's place display plate on which there have been printed numerals of the ten's place of date, and the program wheel which rotation-drives the unit's place wheel and the ten's place wheel in compliance with a program, characterized in that the program wheel is one which is unlocked every day by a predetermined angle by the date indicator driving wheel and thus rotated by one revolution in 31 days, and programmed such that the unit's place wheel is unlocked every day for one tooth from 1st day to 31st day and thus rotated by one revolution in 10 days, the ten's place wheel is unlocked by for one tooth respectively when it shifts from 9th day to 10th day, from 19th day to 20th day and from 29th day to 30th day, and additionally the unit's place wheel is retained to the position of 31st day and the ten's place wheel is unlocked by for one tooth when it shifts from 31st day to 1st day.

The above program, i.e., the program adapted such that the unit's place wheel is unlocked every day for one tooth from 1st day to 31st day and thus rotated by one revolution in 10 days, the ten's place wheel is unlocked by for one tooth when it shifts from 9th day to 10th day, from 19th day to 20th day and from 29th day to 30th day, and additionally the unit's place wheel is retained to the position of 31st day and the ten's place wheel is unlocked by for one tooth when it shifts from 31st day to 1st day, is implemented by a peculiar constitution of the internal teeth of the program wheel. The peculiar constitution of the internal teeth of the program wheel is realized by forming, in the program wheel, the 30 internal teeth for unlocking the unit's place wheel and one skip interval with an equal spacing, and the 4 internal teeth for driving the ten's place wheel. More concretely, the 30 internal teeth for unlocking the unit's place wheel and one skip interval are formed in a lower stage of the program wheel, and the 4 internal teeth for driving the ten's place wheel are formed in an upper stage of the program wheel.

Such a conventional date display mechanism as mentioned above is one which rotation-drives the unit's place wheel and the ten's place wheel by the program wheel having the 4 internal teeth for driving the ten's place wheel. For this reason, since it is necessary to prescribe 2 relative positions between the program wheel and the unit's place wheel and between the program wheel and the ten's place wheel, the above-mentioned conventional date display mechanism has been bad in its assembling property and has brought about an increase in assembling cost. Further, since it is necessary that the unit's place display plate is disposed coaxially with the unit's place wheel and the ten's place display plate with the ten's place wheel, respectively, there is also a problem that a maximum size of numeral appearing in the date display window is limited by a size of each of the unit's place wheel and the ten's place wheel.

A problem that the present invention is to solve is to provide a date display mechanism whose assembling property is high, and which has been constituted by a unit's place wheel which rotation-drives a unit's place display plate on which numerals of a unit's place of date have been printed, a ten's place wheel which rotation-drives a ten's place display plate on which numerals of a ten's place of date have been printed, and a program wheel which controls rotations of the unit's place wheel and the ten's place wheel.

SUMMARY OF THE INVENTION

A date display mechanism has been constituted by making it into a structure in which a unit's place wheel which rotation-drives a unit's place display plate on which numerals of a unit's place of date have been displayed is meshed with a ten's place wheel which rotation-drives a ten's place display plate on which numerals of a ten's place of date have been displayed.

A date display mechanism of the present invention has a date display window, a unit's place display plate disposed such that numeral of a unit's place of date appears in the date display window, a ten's place display plate disposed such that numeral of a ten's place of date appears in the date display window, a unit's place wheel which rotation-drives the unit's place display plate, a ten's place wheel which rotation-drives the ten's place display plate and which is unlocked respectively by for one tooth by the unit's place wheel when it shifts from 9th day to 10th day, from 19th day to 20th day and from 29th day to 30th day, and a program wheel which is rotated by one revolution in 31 days by being unlocked every day by a predetermined angle by a date indicator driving wheel and which has been programmed such that, from 1st day to 31st day, the unit's place wheel is unlocked every day for one tooth to thereby be rotated by one revolution in 10 days and, when it shifts from 31st day to 1st day, the unit's place wheel is retained to a position of 31st day and the ten's place wheel is unlocked by for one tooth.

In a date display mechanism of the present invention, the program wheel is one in which, in its 1st stage, there are formed 30 internal teeth for unlocking the unit's place wheel and one skip interval with an equal angle spacing and, in its 2nd stage, there is formed one internal tooth for driving the ten's place wheel, and the ten's place wheel meshes with the one internal tooth for driving the ten's place wheel of the program wheel through a ten's place wheel driving wheel.

In a date display mechanism of the present invention, the date display window is disposed in a 12 o'clock position, the unit's place display plate is formed monolithically with a surface of the unit's place wheel or, after forming separately, each is fixation-formed, and additionally the ten's place display plate is formed in a surface of the ten's place wheel.

In a date display mechanism of the present invention, the date display window is disposed in a 12 o'clock position, the unit's place display plate is one having a larger diameter than the unit's place wheel and is disposed coaxially with the unit's place wheel, the ten's place display plate is one having a larger diameter than the ten's place wheel and is disposed coaxially with the ten's place wheel, and additionally the ten's place wheel meshes with the unit's place wheel through an intermediate wheel.

In a date display mechanism of the present invention, the date display window is disposed in a 3 o'clock position, the unit's place display plate is formed monolithically with a surface of the program wheel or, after forming separately, each is fixation-formed, the ten's place display plate is one of an inner diameter degree of the program wheel and is disposed coaxially with the program wheel, and additionally the ten's place wheel is disposed coaxially with the program wheel.

In a date display mechanism of the present invention, the date display window is disposed in a 6 o'clock position, the unit's place display plate is formed monolithically with a surface of the program wheel or, after forming separately, each is fixation-formed, the ten's place display plate is one having a larger diameter than the ten's place wheel, and additionally the ten's place wheel is disposed in a 6 o'clock position.

The present invention also provides a timepiece having a date display mechanism of the present invention as set forth above.

BRIEF DESCRIPTION OF THE DRAWINGS

A preferred form of the present invention is illustrated in the accompanying drawings in which.

DETAILED DESCRIPTION OF THE PREFERRED EMBODIMENTS

A date display mechanism concerning the present invention is constituted by a date display window, a unit's place display plate disposed such that numeral of a unit 's place of date appears in the date display window, a ten's place display plate disposed such that numeral of a ten's place of date appears in the date display window, a unit's place wheel which rotation-drives the unit's place display plate, a ten's place wheel which rotation-drives the ten's place display plate and which is unlocked respectively by for one tooth by the unit's place wheel when it shifts from 9th day to 10th day, from 19th day to 20th day and from 29th day to 30th day, and a program wheel which is rotated by one revolution in 31 days by being unlocked every day by a predetermined angle by a date indicator driving wheel and which has been programmed such that, from 1st day to 31st day, the unit's place wheel is unlocked every day for one tooth to thereby be rotated by one revolution in 10 days and, when it shifts from 31st day to 1st day, the unit's place wheel is retained to a position of 31st day and the ten's place wheel is unlocked by for one tooth.

Embodiment 1

Figure 1:
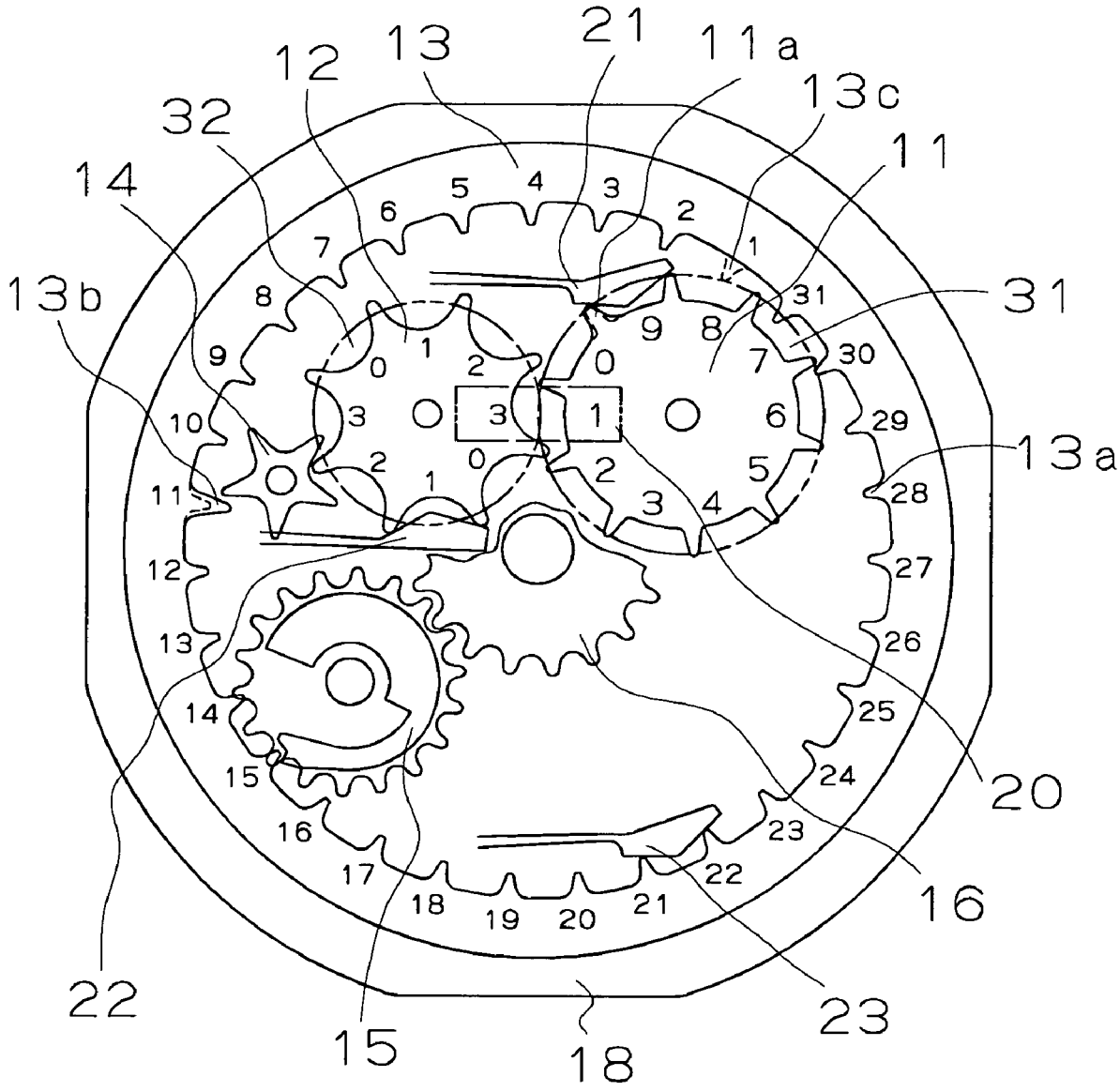
FIG. 1 is a front view of a timepiece possessing a date display mechanism of an Embodiment 1 of the present invention, in which a date display window has been disposed in a 12 o'clock position, where components having no relation with the explanation of the present invention have been omitted.
Figure 2A:
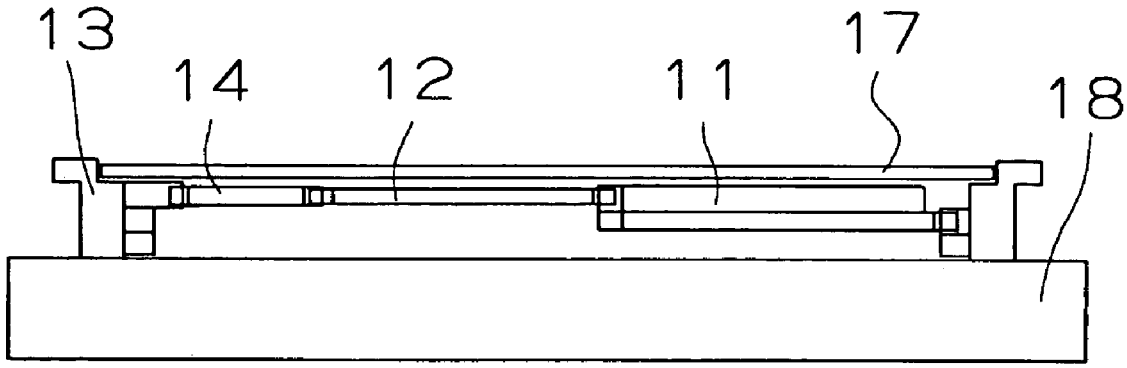
FIG. 2A is a sectional view of the timepiece possessing the date display mechanism of the Embodiment 1 of FIG. 1, when a 12 o'clock direction has been seen while being sectioned along a line coaxial with a winding stem.
Figure 2B:
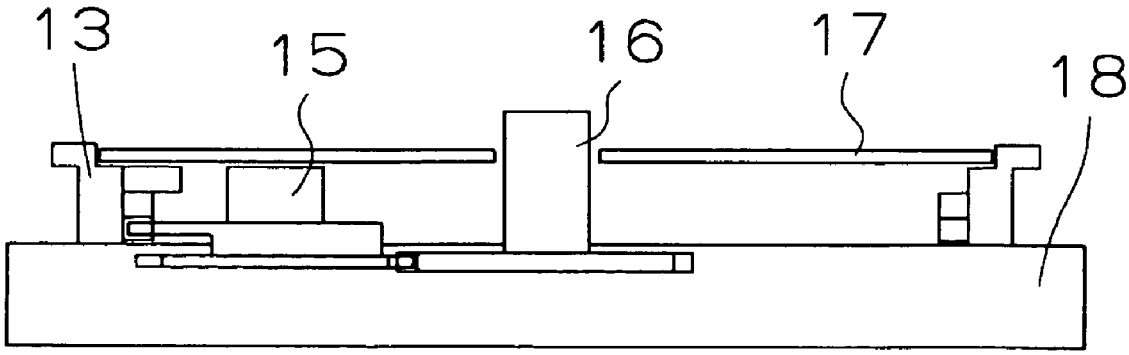
FIG. 2B is a sectional view of the timepiece possessing the date display mechanism of the Embodiment 1 of FIG. 1, when a 6 o'clock direction has been seen.

As shown in a plan view of FIG. 1 and sectional views of FIGS. 2A-2B, a date display mechanism of the Embodiment 1 is one in which a date display window 20 has been disposed in a 12 o'clock position.

That is, the date display mechanism of the Embodiment 1 is constituted by the date display window 20, a unit's place display plate 31 (first date indicator) disposed such that numeral of the unit's place of date appears in the date display window 20, a unit's place wheel 11 (first driving wheel) which rotation-drives the unit's place display plate 31, a ten's place display plate 32 (second date indicator) disposed such that numeral of the ten's place of date appears in the date display window 20, a ten's place wheel 12 (second driving wheel) which rotation-drives the ten's place display plate 32, and a program wheel 13 which is unlocked every day by a predetermined angle by a date indicator driving wheel 15 and thus rotated by one revolution in 31 days.

The unit's place wheel 11 is disposed in a right side of the date display window 20, and the ten's place wheel 12 is disposed in a left side of the date display window 20. The unit's place display plate 31 is a disc whose diameter is the same as the unit's place wheel 11, and formed monolithically with a surface of the unit's place wheel 11. Further, the ten's place display plate 32 is a disc whose diameter is the same as the ten's place wheel 12, and formed monolithically with a surface of the ten's place wheel 12.

The program wheel 13 is a component in which, in its 1st stage (lower stage), there have been formed 30 internal teeth 13*a* for unlocking the unit's place wheel and one interval portion or skip interval 13*c* with an equal spacing and, in its 2nd stage (upper stage), there has been formed one internal tooth 13*b* (driving internal tooth) for driving the ten's place wheel. (Hereunder, Embodiments 2-4 have similar relation as well.) The unit's place wheel 11 is a component in which, in its lower stage, there have been formed 10 teeth meshing with the internal teeth 13*a* of the program wheel 13 and, in its upper stage, there has been formed one tooth 11*a* meshing with the ten's place wheel 12. The ten's place wheel 12 is a component having 8 teeth meshing with the tooth 11*a* of the unit's place wheel 11. A ten's place wheel driving wheel 14 is a component having 5 teeth meshing with the internal tooth 13*b* of the program wheel 13.

The unit's place wheel 11 is disposed such that its 10 teeth in the lower stage mesh with 30 internal teeth 13*a* in the lower stage of the program wheel 13. The ten's place wheel 12 is disposed such that its 8 teeth mesh with one tooth 11*a* in the upper stage of the unit's place wheel 11. At the same time, the ten's place wheel 12 is disposed such that its 8 teeth mesh with one internal tooth 13*b* in the upper stage of the program wheel 13 through the ten's place wheel driving wheel 14.

The unit's place wheel 11 is set by a unit's place wheel jumper 21, the ten's place wheel 12 is set by a ten's place wheel jumper 22, and the program wheel 13 is set by a program wheel jumper 23.

In the date display mechanism of the Embodiment 1 constituted as mentioned above, from 1st day to 31st day, the program wheel 13 unlocks every day the unit's place wheel 11 for one tooth and thereby rotates it by one revolution in 10 days. And, when it shifts from 9th day to 10th day, from 19th day to 20th day and 29th day to 30th day, the unit's place wheel 11 unlocks the ten's place wheel 12 respectively by for one tooth. Accordingly, from 1st day to 31st day, date from "01" to "31" appears in order in the date display window 20 disposed in the 12 o'clock position.

When it shifts from 31st day to 1st day, the skip interval 13*c*, i.e., interval where there exists no internal tooth 13*a* for unlocking the unit's place wheel, of the program wheel 13 faces on the tooth of the unit's place wheel 11. Accordingly, the program wheel 13 retains the unit's place wheel 11 to a rotation position of 31st day, so that numeral "1" of the unit's place display plate 31 appearing in the unit's place part of the date display window 20 is intact. At the same time, as to the program wheel 13, its one internal tooth 13*b* for driving the ten's place wheel meshes with the tooth of the ten's place wheel driving wheel 14, thereby unlocking the ten's place wheel 12 by for one tooth through the ten s place wheel driving wheel 14. Accordingly, numeral "3" of the ten's place display plate 32 appearing in the ten's place part of the date display window 20 changes to "0". In this manner, when it shifts from 31st day to 1st day, a display appearing in the date display window 20 surely changes from "31" to "01".

Figure 3:
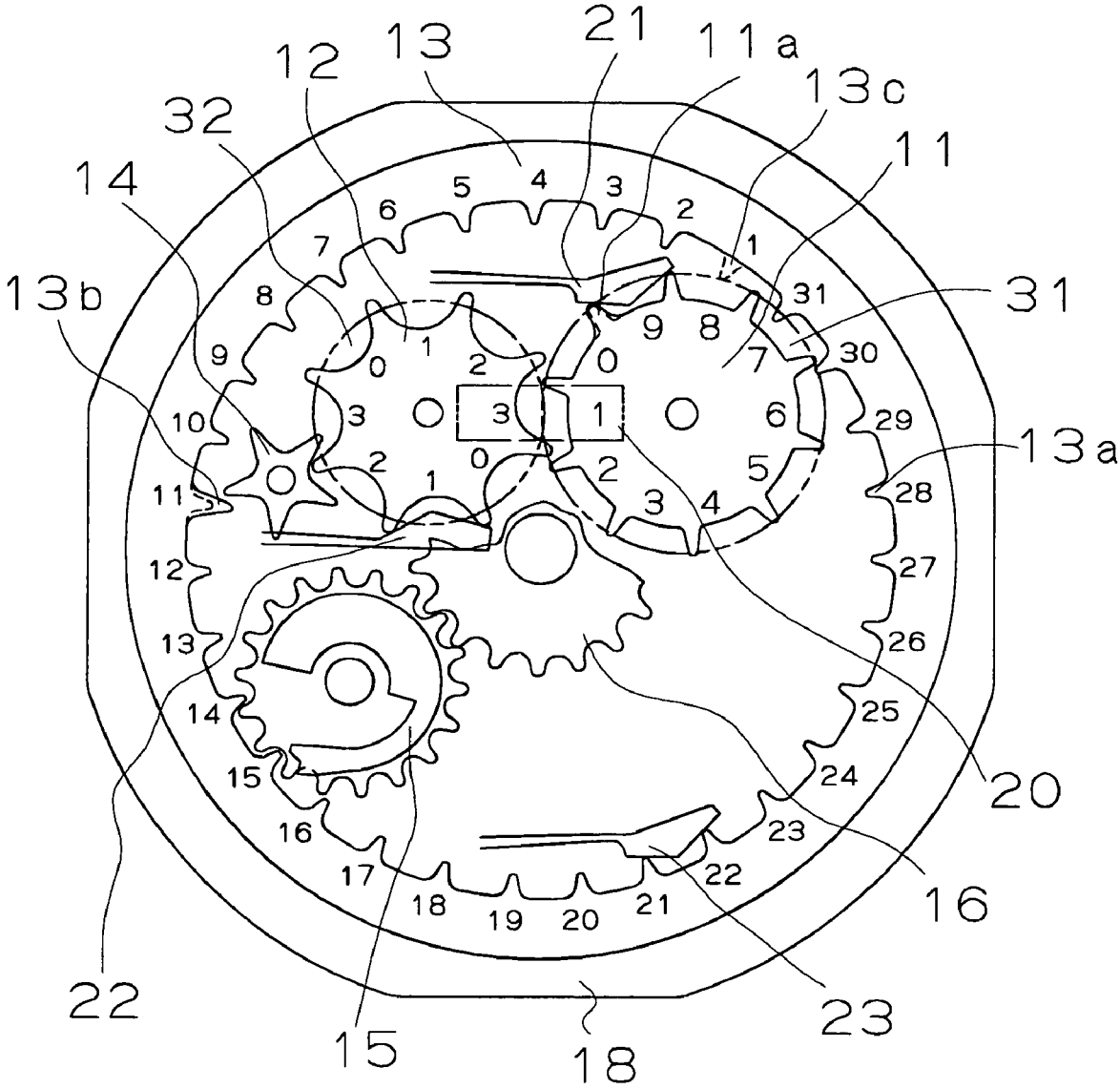
FIG. 3 is a view showing rotation positions of a unit's place wheel, a ten's place wheel, a ten's place wheel driving wheel and a program wheel when it shifts from 31st day to 1st day, where each wheel exists in its settled position of "31st" day.
Figure 4:
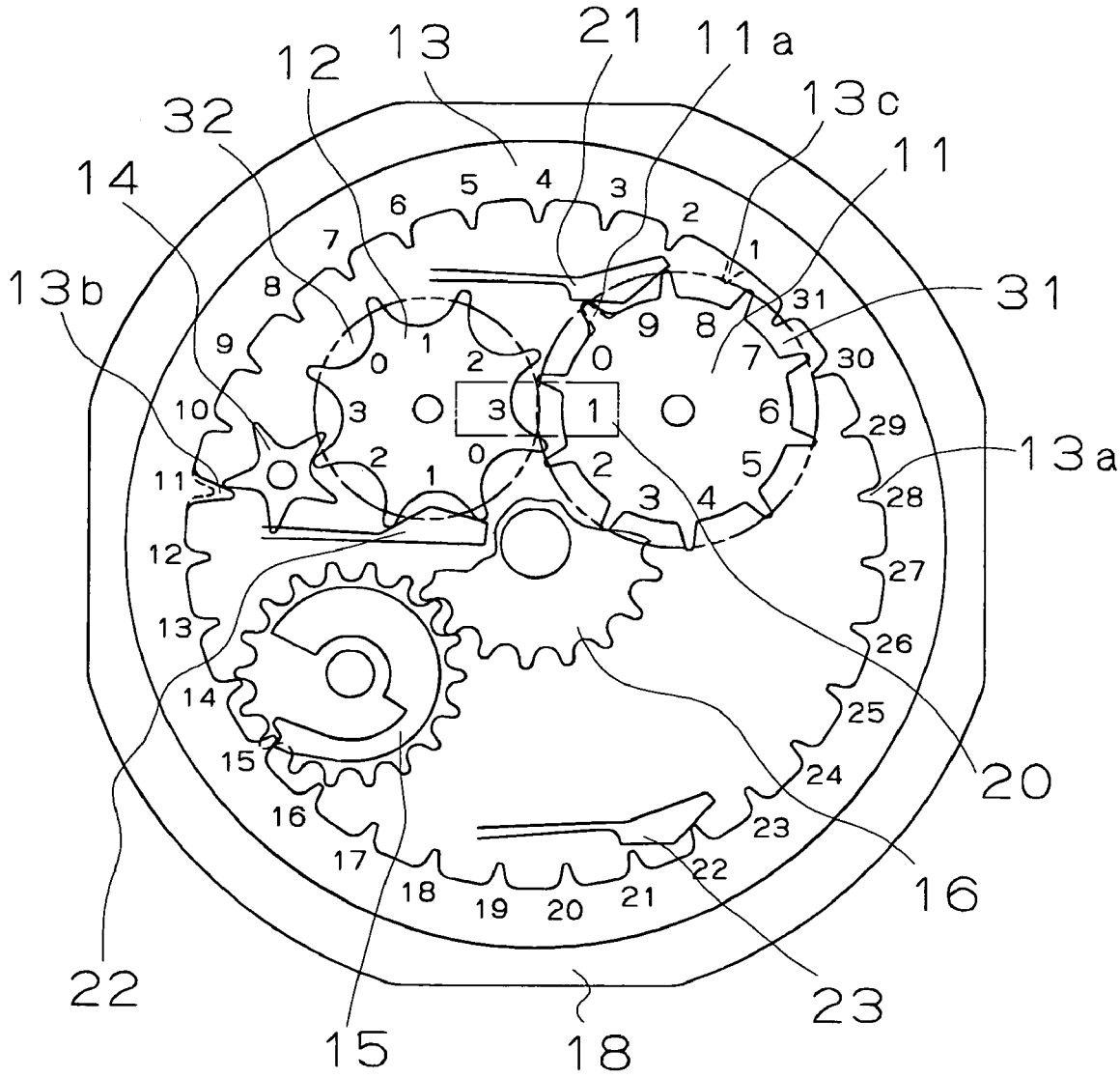
FIG. 4 is a view showing rotation positions of the unit's place wheel, the ten's place wheel driving wheel and the program wheel when it shifts from 31st day to 1st day where, the ten's place wheel exists in its unlocking start position.
Figure 5:
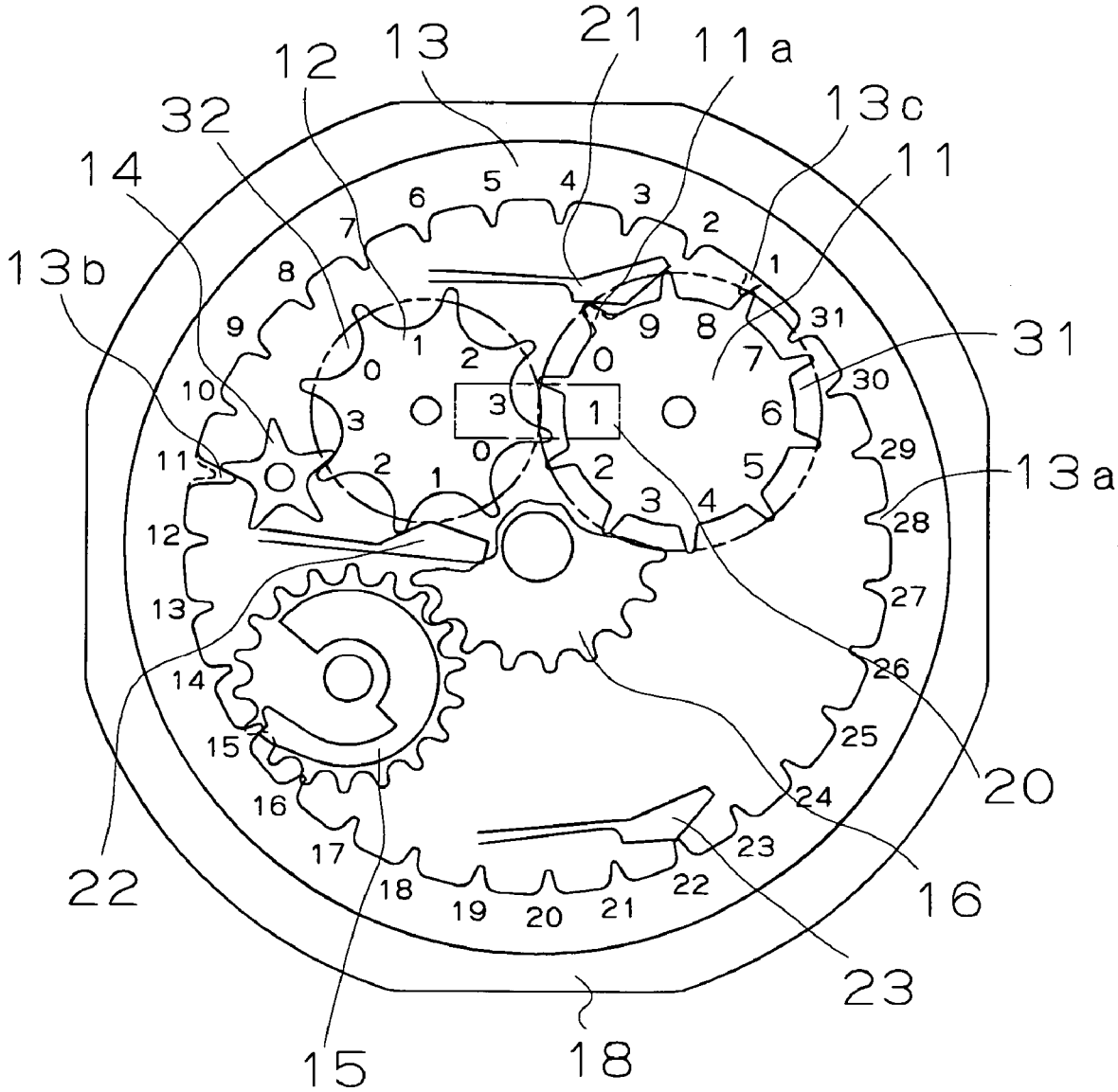
FIG. 5 is a view showing rotation positions of the unit's place wheel, the ten's place wheel and the ten's place wheel driving wheel when it shifts from 31st day to 1st day, where, the program wheel exists in its skip position.
Figure 6:
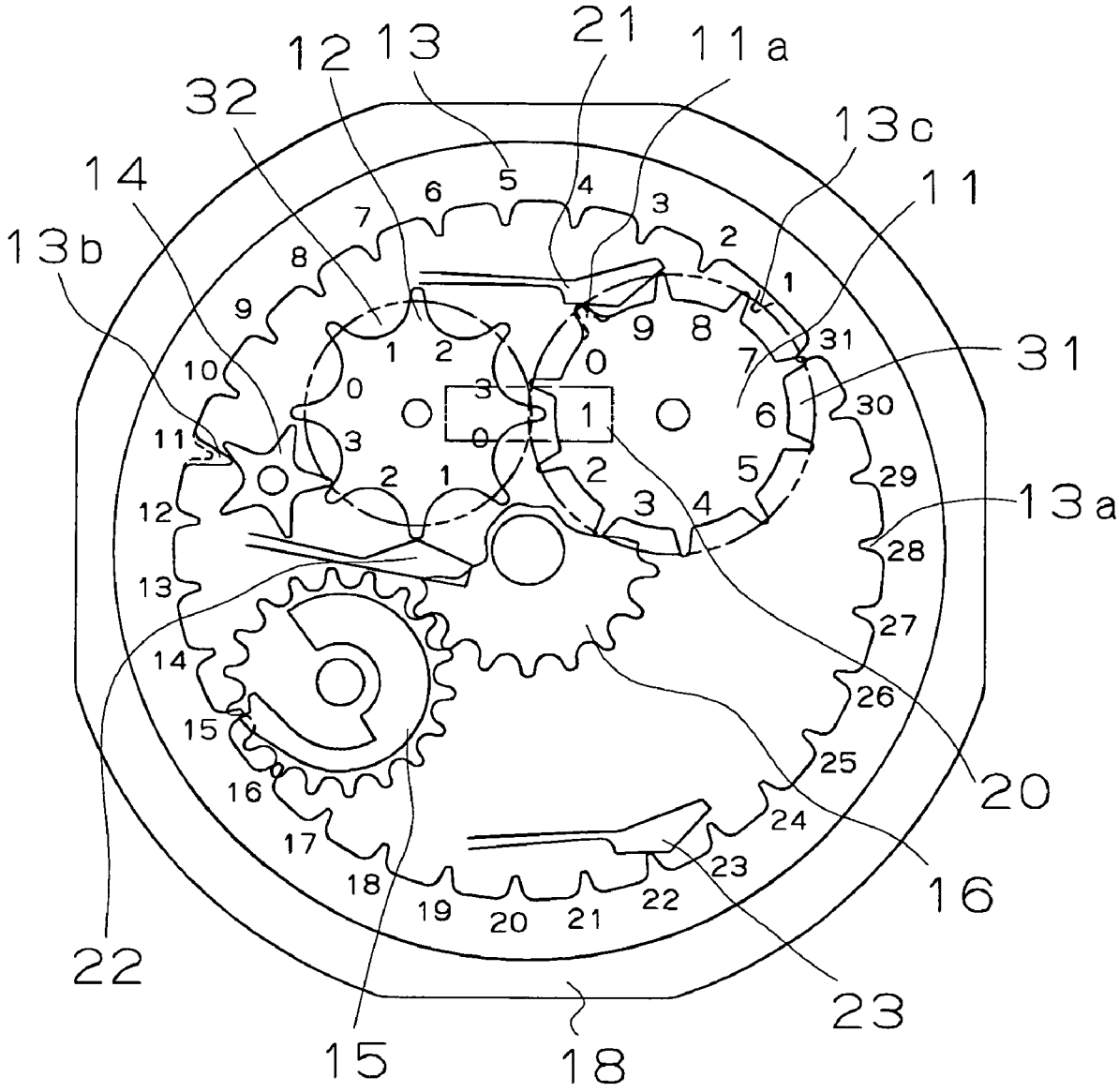
FIG. 6 is a view showing rotation positions of the unit's place wheel, the ten's place wheel driving wheel and the program wheel when it shifts from 31st day to 1st day, where the ten's place wheel exists in its skip position.
Figure 7:
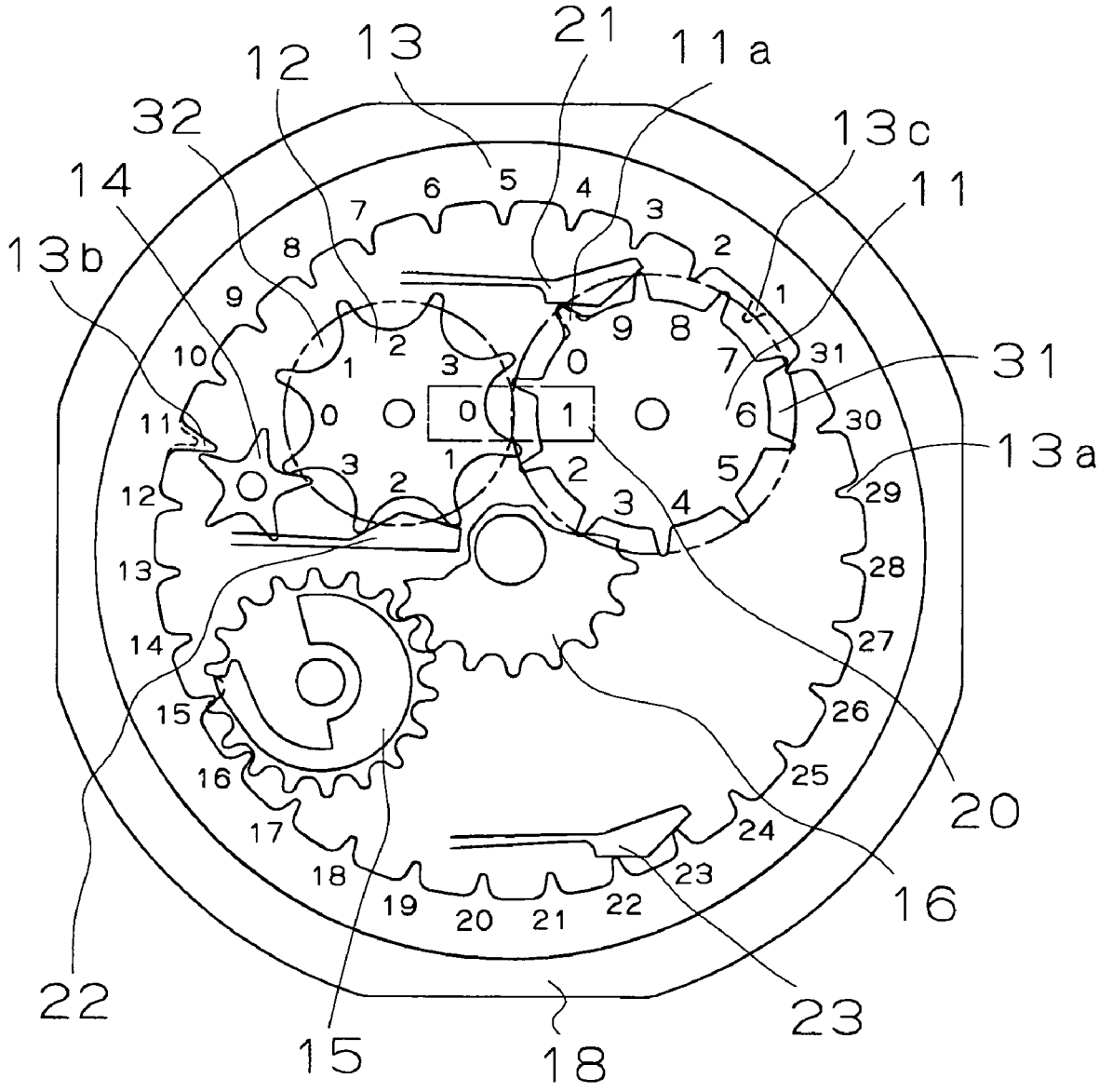
FIG. 7 is a view showing rotation positions of the unit's place wheel, the ten's place wheel, the ten's place wheel driving wheel and the program wheel when it shifts from 31st day to 1st day, where each wheel exists in its settled position of "1st" day.

FIG. 3-FIG. 7 show motions of the unit's place wheel 11, the ten's place wheel 12, the program wheel 13, and the ten s place wheel driving wheel 14. That is, FIG. 3 shows a state that the unit's place wheel 11, the ten's place wheel 12 and the program wheel 13 exist in their settled positions. FIG. 4 shows a state that the ten's place wheel 12 exists in its unlocking start position. FIG. 5 shows a state that the program wheel 13 exists in its skip position. FIG. 6 shows a state that the ten's place wheel 12 exists in its skip position. And, FIG. 7 shows a state that the unit's place wheel 11, the ten's place wheel 12 and the program wheel 13 exist in their settled positions of "1st" day.

Embodiment 2

Figure 8:
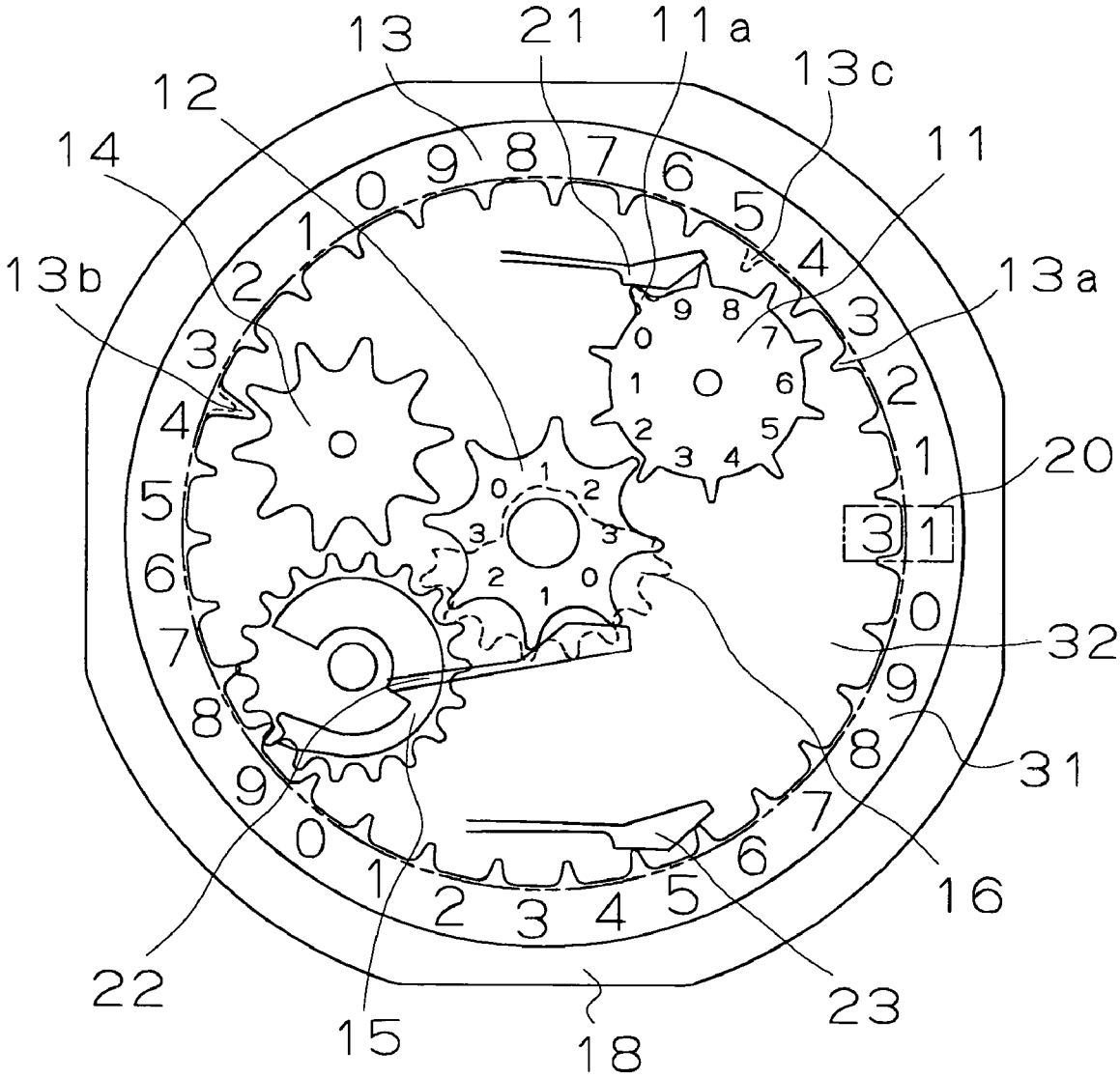
FIG. 8 is a front view of a timepiece possessing a date display mechanism of an Embodiment 2 of the present invention, in which the date display window has been disposed in a 3 o'clock position, where components having no relation with the explanation of the present invention are shown while being omitted.
Figure 9A:
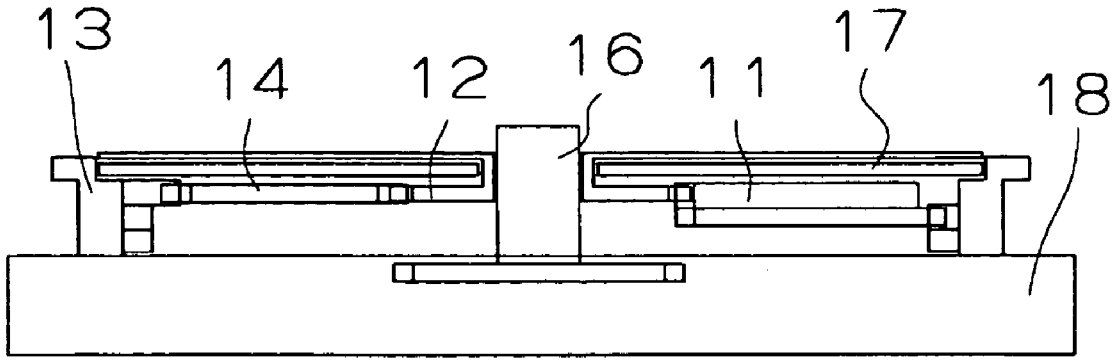
FIG. 9A is a sectional view of the timepiece possessing the date display mechanism of the Embodiment 2 of FIG. 8, when the 12 o'clock direction has been seen while being sectioned along the line coaxial with the winding stem.
Figure 9B:
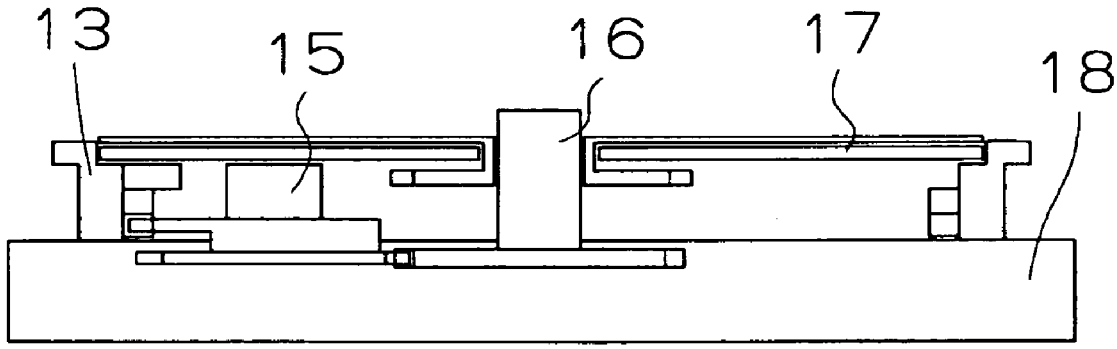
FIG. 9B is a sectional view of the timepiece possessing the date display mechanism of the Embodiment 1 of FIG. 8, when the 6 o'clock direction has been seen.

As shown in a plan view of FIG. 8 and sectional views of FIGS. 9, the Embodiment 2 is one in which the date display window 20 has been disposed in a 3 o'clock position.

It is constituted by the unit's place display plate 31 disposed so as to appear in 20, the unit's place wheel 11 which rotation-drives the unit's place display plate 31, the ten's place display plate 32 disposed such that numeral of the ten's place of date appears in the date display window 20, the ten's place wheel 12 which rotation-drives the ten's place display plate 32, and the program wheel 13 which is unlocked every day by the predetermined angle by the date indicator driving wheel 15 and thus rotated by one revolution in 31 days.

And, the unit's place wheel 11 is disposed in a 2 o'clock position in a left obliquely-upper part of the date display window 20, and the ten's place wheel 12 is disposed in left of the date display window 20, i.e., coaxially with an hour wheel 16. And, the unit's plate display plate 31 is formed in a surface of the program wheel 13. Further, the ten's place display plate 32 is a disk of an inner diameter degree of the program wheel, and coaxially attached to the surface of the ten's place wheel 12.

The unit's place wheel 11 is disposed such that its 10 teeth in the lower stage mesh with 30 internal teeth 13*a* in the lower stage of the program wheel 13. The ten's place wheel 12 is disposed such that its 8 teeth mesh with one tooth 11*a* in the upper stage of the unit's place wheel 11. At the same time, the ten's place wheel 12 is disposed such that its 8 teeth mesh with one internal tooth 13*b* in the upper stage of the program wheel 13 through the ten's place wheel driving wheel 14.

In the date display mechanism of the Embodiment 2 constituted as mentioned above, from 1st day to 31st day, the program wheel 13 unlocks every day the unit's place wheel 11 for one tooth and thereby rotates it by one revolution in 10 days. And, when it shifts from 9th day to 10th day, from 19th day to 20th day and 29th day to 30th day, the unit's place wheel 11 unlocks the ten's place wheel 12 respectively by for one tooth. Accordingly, from 1st day to 31st day, date from "01" to "31" appears in order in the date display window 20 disposed in the 3 o'clock position.

When it shifts from 31st day to 1st day, the skip interval 13*c*, i.e., interval where there exists no internal tooth 13*a* for unlocking the unit's place wheel, of the program wheel 13 faces on the tooth of the unit's place wheel 11. Accordingly, the program wheel 13 retains the unit's place wheel 11 to the rotation position of 31st day, so that numeral "1" of the unit's place display plate 31 appearing in the unit's place part of the date display window 20 is intact. At the same time, as to the program wheel 13, its one internal tooth 13*b* for driving the ten's place wheel meshes with the tooth of the ten's place wheel driving wheel 14, thereby unlocking the ten's place wheel 12 by for one tooth through the ten s place wheel driving wheel 14. Accordingly, numeral "3" of the ten's place display plate 32 appearing in the ten's place part of the date display window 20 changes to "0". In this manner, when it shifts from 31st day to 1st day, the display appearing in the date display window 20 disposed in the 3 o'clock position surely changes from "31" to "01".

In the date display mechanism of the Embodiment 2, since the unit's place display plate 31 and the ten's place display plate 32 can be made into ones whose diameters are larger than the Embodiment 1, the date display has become more possible.

Embodiment 3

Figure 10:
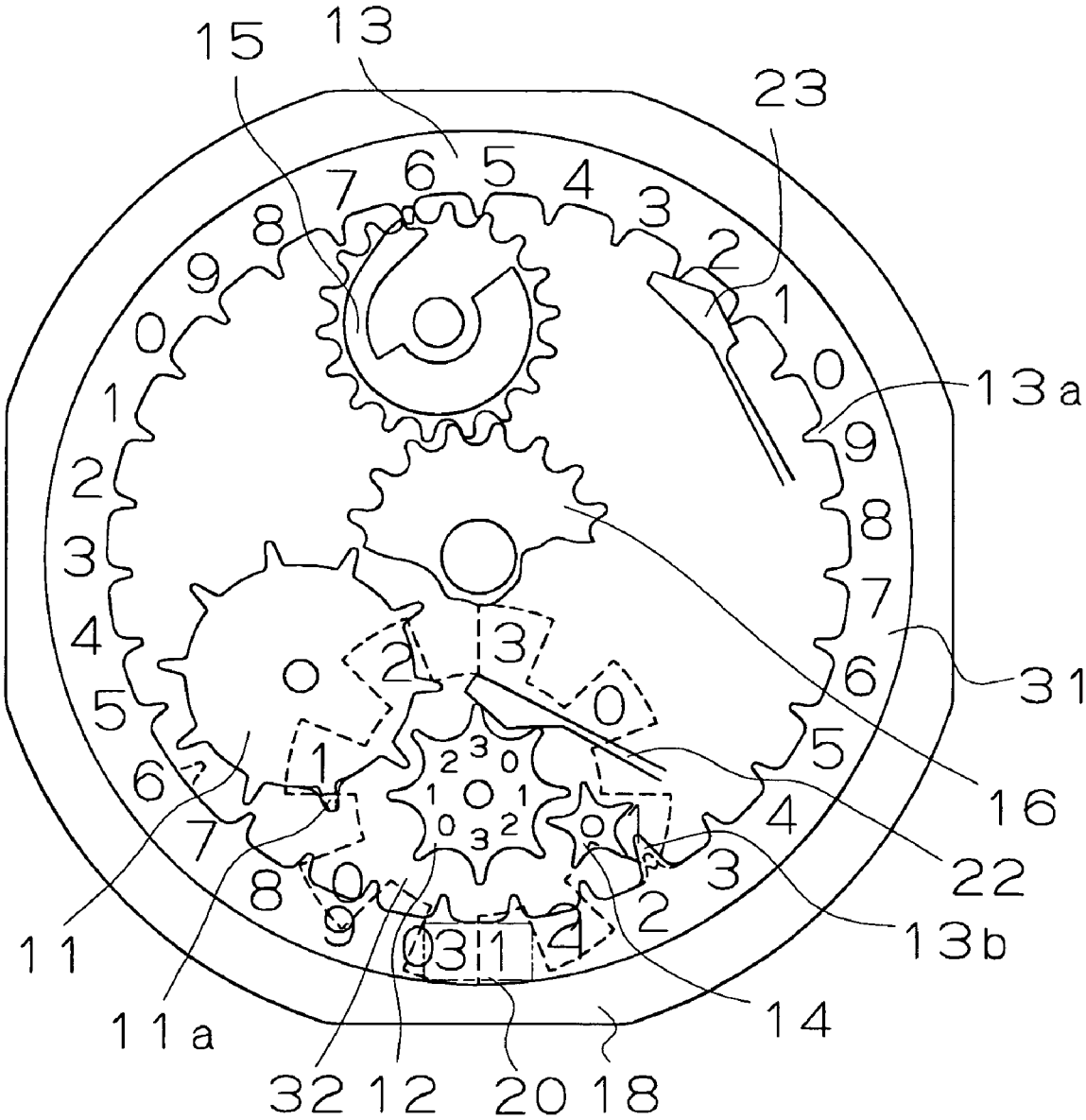
FIG. 10 is a front view of a timepiece possessing a date display mechanism of an Embodiment 3 of the present invention, in which the date display window has been disposed in a 6 o'clock position, where components having no relation with the explanation of the present invention are shown while being omitted.
Figure 11A:
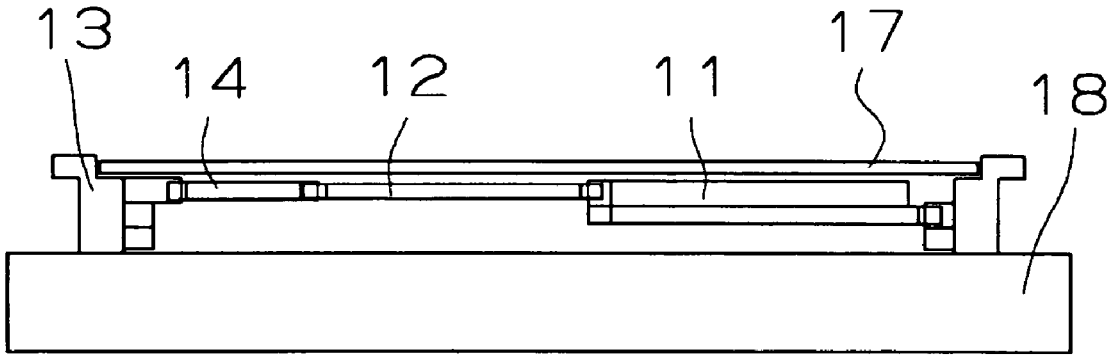
FIG. 11A is a sectional view of the timepiece possessing the date display mechanism of the Embodiment 3 of FIG. 10, when the 12 o'clock direction has been seen while being sectioned along the line coaxial with the winding stem.
Figure 11B:
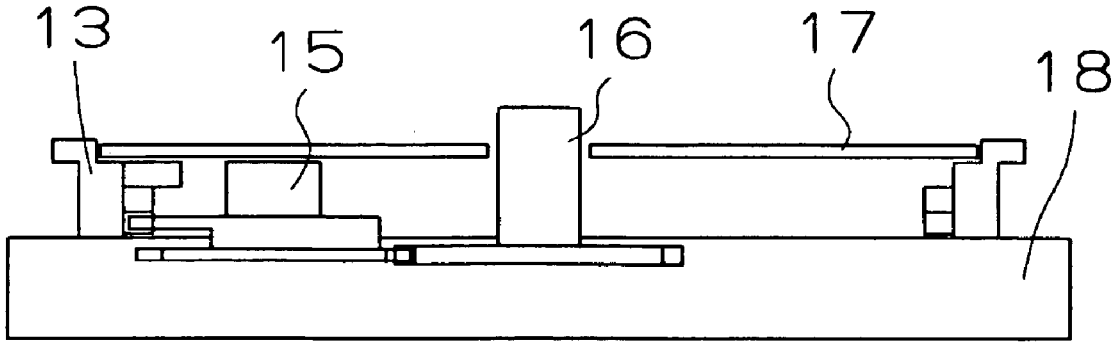
FIG. 11B is a sectional view of the timepiece possessing the date display mechanism of the Embodiment 1 of FIG. 10, when the 6 o'clock direction has been seen.

As shown in a plan view of FIG. 10 and sectional views of FIGS. 11, the Embodiment 3 is one in which the date display window 20 has been disposed in a 6 o'clock position.

That is, the date display mechanism of the Embodiment 3 is constituted by the date display window 20, the unit's place display plate 31 disposed such that numeral of the unit's place of date appears in the date display window 20, the unit's place wheel 11 which rotation-drives the unit's place display plate 31, the ten's place display plate 32 disposed such that numeral of the ten's place of date appears in the date display window 20, the ten's place wheel 12 which rotation-drives the ten's place display plate 32, and the program wheel 13 which is unlocked every day by the predetermined angle by the date indicator driving wheel 15 and thus rotated by one revolution in 31 days.

The unit's place wheel 11 is disposed in an 8 o'clock position that is a left upper side of the date display window 20, and the ten's place wheel 12 is disposed in a 6 o'clock position in an upper side of the date display window 20. The unit's place display plate 31 is a doughnut-shaped disc whose diameter is the same as the program wheel 13, and formed monolithically with the surface of the program wheel 13. Further, the ten's place display plate 32 is a disc-like component having an inner diameter of about 2 times of the ten's place wheel 12, and attached coaxially with the surface of the ten's place wheel 12.

The unit's place wheel 11 is disposed such that its 10 teeth in the lower stage mesh with 30 internal teeth 13*a* in the lower stage of the program wheel 13. The ten's place wheel 12 is disposed such that its 8 teeth mesh with one tooth 11*a* in the upper stage of the unit's place wheel 11. At the same time, the ten's place wheel 12 is disposed such that its 8 teeth mesh with one internal tooth 13*b* in the upper stage of the program wheel 13 through the ten's place wheel driving wheel 14.

In the date display mechanism of the Embodiment 3 constituted as mentioned above, from 1st day to 31st day, the program wheel 13 unlocks every day the unit's place wheel 11 for one tooth and thereby rotates it by one revolution in 10 days. And, when it shifts from 9th day to 10th day, from 19th day to 20th day and 29th day to 30th day, the unit's place wheel 11 unlocks the ten's place wheel 12 respectively by for one tooth. Accordingly, from 1st day to 31st day, date from "01" to "31" appears in order in the date display window 20 disposed in the 6 o'clock position.

When it shifts from 31st day to 1st day, the skip interval 13*c*, i.e., interval where there exists no internal tooth 13*a* for unlocking the unit's place wheel, of the program wheel 13 faces on the tooth of the unit's place wheel 11. Accordingly, the program wheel 13 retains the unit's place wheel 11 to the rotation position of 31st day, so that numeral "1" of the unit's place display plate 31 appearing in the unit's place part of the date display window 20 is intact. At the same time, as to the program wheel 13, its one internal tooth 13*b* for driving the ten's place wheel meshes with the tooth of the ten's place wheel driving wheel 14, thereby unlocking the ten's place wheel 12 by for one tooth through the ten s place wheel driving wheel 14. Accordingly, numeral "3" of the ten's place display plate 32 appearing in the ten's place part of the date display window 20 changes to "0". In this manner, when it shifts from 31st day to 1st day, the display appearing in the date display window 20 in the 6 o'clock position surely changes from "31" to "01".

In the date display mechanism of the Embodiment 3, since the unit's place display plate 31 and the ten's place display plate 32 can be made into ones whose diameters are larger than the Embodiment 1, the date display has become more possible.

Embodiment 4

Figure 12:
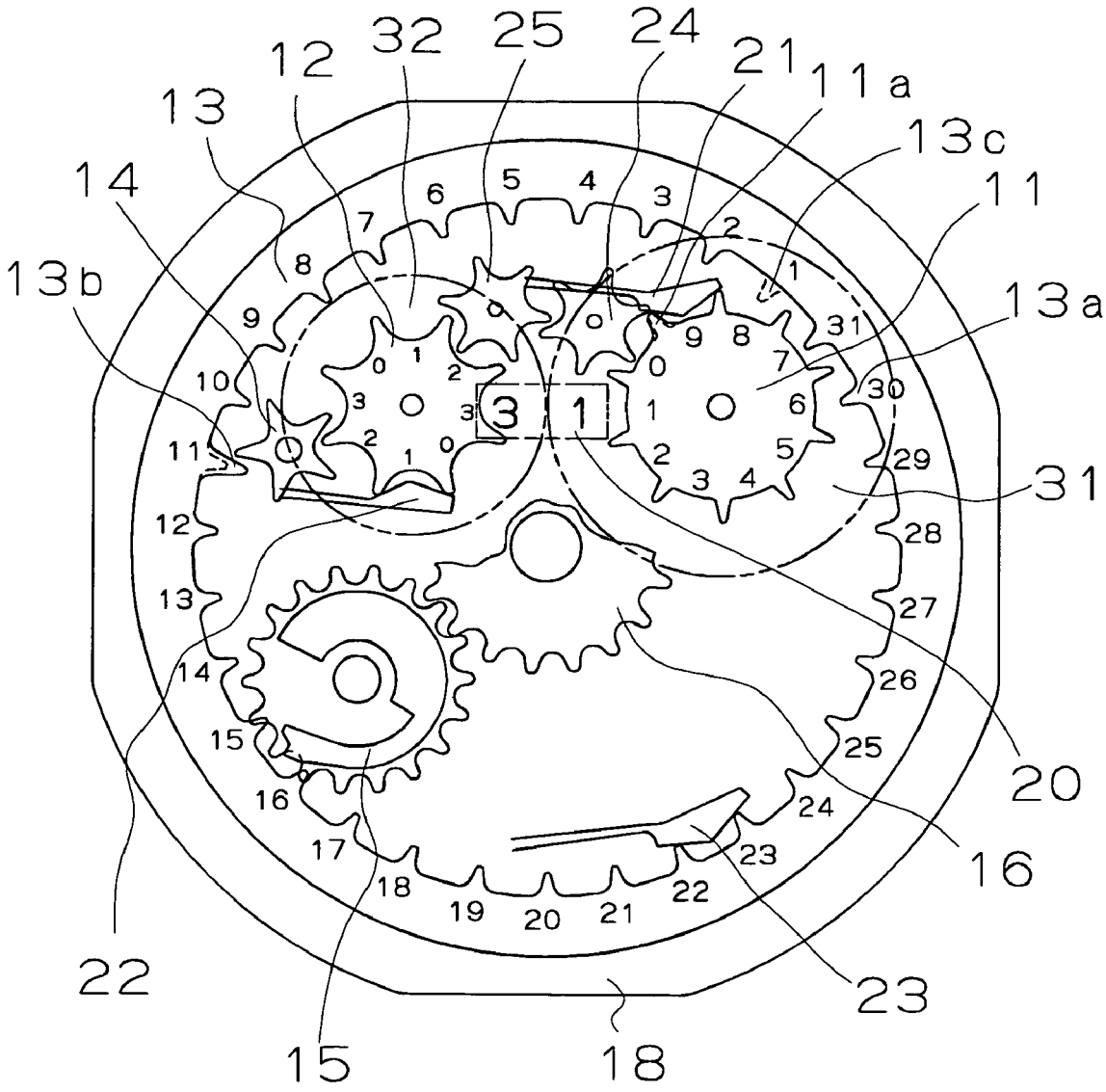
FIG. 12 is a front view of a timepiece possessing a date display mechanism of an Embodiment 4 of the present invention, in which the date display window has been disposed in the 12 o'clock position, where components having no relation with the explanation of the present invention are shown while being omitted.
Figure 13A:
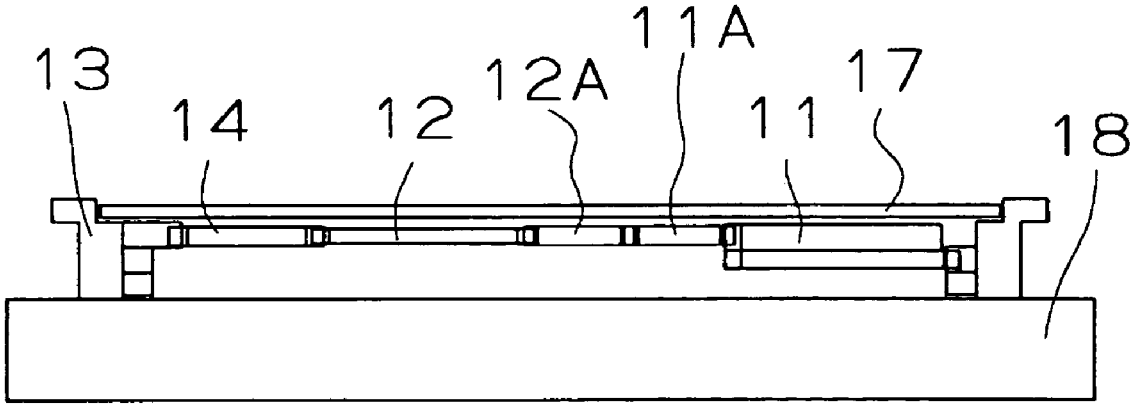
FIG. 13A is a sectional view of the timepiece possessing the date display mechanism of the Embodiment 1 of FIG. 12, when the 12 o'clock direction has been seen while being sectioned along the line coaxial with the winding stem.
Figure 13B:
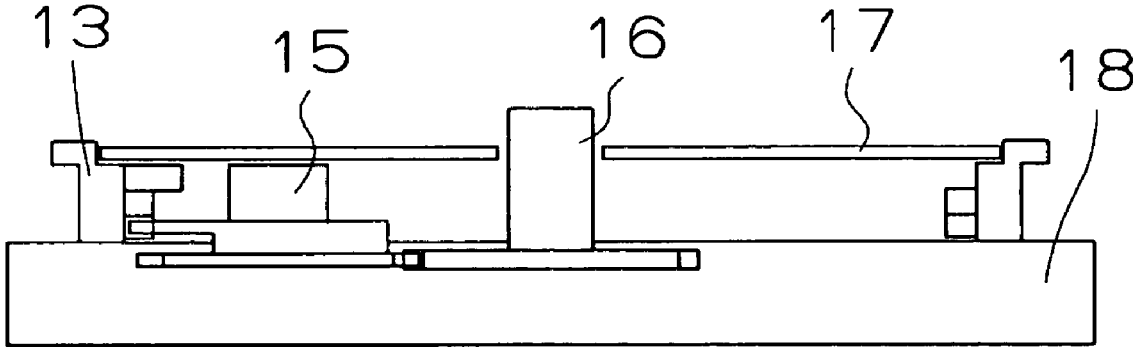
FIG. 13B is a sectional view of the timepiece possessing the date display mechanism of the Embodiment 1 of FIG. 12, when the 6 o'clock direction has been seen.

As shown in a plan view of FIG. 12 and sectional views of FIGS. 13, the Embodiment 4 is one in which the date display window 20 has been disposed in the 12 o'clock position, and is a modification of the Embodiment 1.

That is, the date display mechanism of the Embodiment 4 is constituted by the date display window 20, the unit's place display plate 31 disposed such that numeral of the unit's place of date appears in the date display window 20, the unit's place wheel 11 which rotation-drives the unit's place display plate 31, the ten's place display plate 32 disposed such that numeral of the ten's place of date appears in the date display window 20, the ten's place wheel 12 which rotation-drives the ten's place display plate 32, and the program wheel 13 which is unlocked every day by the predetermined angle by the date indicator driving wheel 15 and thus rotated by one revolution in 31 days.

And, the unit's place wheel 11 is disposed in the right side of the date display window 20, and the ten's place wheel 12 is disposed in the left side of the date display window 20 while being spaced so as not to directly mesh with the unit's place wheel 11. The unit's place display plate 31 is a disc having an inner diameter of about 2 times of the unit's place wheel 11, and formed monolithically with the surface of the unit's place wheel 11. Further, the ten's place display plate 32 is a disc having an inner diameter of about 2 times of the ten's place wheel 12, and formed monolithically with the surface of the ten's place wheel 12.

The constitutions of the unit's place wheel 11, the ten's place wheel 12, the program wheel 13 and the ten's place wheel driving wheel 14 are all the same as the Embodiment 1.

The unit's place wheel 11 is disposed such that its 10 teeth in the lower stage mesh with 30 internal teeth 13*a* in the lower stage of the program wheel 13. The ten's place wheel 12 is disposed such that its 8 teeth mesh with one tooth 11*a* in the upper stage of the unit 's place wheel 11 through a unit's place wheel intermediate wheel 24 and a ten's place wheel intermediate wheel 25. At the same time, the ten's place wheel 12 is disposed such that its 8 teeth mesh with one internal tooth 13*b* in the upper stage of the program wheel 13 through the ten's place wheel driving wheel 14.

In the date display mechanism of the Embodiment 4 constituted as mentioned above, from 1st day to 31st day, the program wheel 13 unlocks every day the unit's place wheel 11 for one tooth and thereby rotates it by one revolution in 10 days. And, when it shifts from 9th day to 10th day, from 19th day to 20th day and 29th day to 30th day, the unit's place wheel 11 unlocks the ten's place wheel 12 respectively by for one tooth. Accordingly, from 1st day to 31st day, date from "01" to "31" appears in order in the date display window 20 disposed in the 12 o'clock position.

When it shifts from 31st day to 1st day, the skip interval 13*c*, i.e., interval where there exists no internal tooth 13*a* for unlocking the unit's place wheel, of the program wheel 13 faces on the tooth of the unit's place wheel 11. Accordingly, the program wheel 13 retains the unit's place wheel 11 to the rotation position of 31st day, so that numeral "1" of the unit's place display plate 31 appearing in the unit's place part of the date display window 20 is intact. At the same time, as to the program wheel 13, its one internal tooth 13*b* for driving the ten's place wheel meshes with the tooth of the ten's place wheel driving wheel 14, thereby unlocking the ten's place wheel 12 by for one tooth through the ten s place wheel driving wheel 14. Accordingly, numeral "3" of the ten's place display plate 32 appearing in the ten's place part of the date display window 20 changes to "0". In this manner, when it shifts from 31st day to 1st day, the display appearing in the date display window 20 disposed in the 12 o'clock position surely changes from "31" to "01".

In the date display mechanism of the Embodiment 4, since the unit's place display plate 31 and the ten's place display plate 32 can be made into ones whose diameters are larger than the Embodiment 1, the date display has become more possible.

Since the present invention is the date display mechanism made into a structure in which the unit's place wheel which rotation-drives the unit's place display plate on which there have been displayed numerals of the unit's place of date is meshed with the ten's place wheel which rotation-drives the ten's place display plate on which there have been displayed numerals of the ten's place of date, if a relative position between the program wheel and the unit's place wheel is prescribed, it has become unnecessary to prescribe an incorporation position of the ten's place wheel. Accordingly, an incorporation property of the date display mechanism is improved, and thus a workability for incorporating a movement of the timepiece has been improved.

Further, since a size of the unit's place display plate can be made larger than the unit's place wheel and a size of the ten's place display plate larger than the ten's place wheel, the date display has become more possible than the prior art. Moreover, since the date display window can be disposed not only in the 12 o'clock position but also in the 3 o'clock position, the 6 o'clock position and the like, a degree of freedom in designing the date display mechanism has become large. Additionally further, since the internal tooth for unlocking the ten's place wheel is one, a manufacture of the program wheel has become easy.

What is claimed is:

1. A date display mechanism comprising:

a date display window for displaying places of units and tens among dates from a 1st day to a 31st day;

a units place display plate having toothing and having numerals on a surface thereof corresponding to the places of units of the date, the units place display plate being positioned so that one of the places of units is displayed by the date display window;

a tens place display plate having toothing and having numerals on a surface thereof corresponding to the places of tens of the date, the tens place display plate being positioned to that one of the places of tens is displayed by the date display window;

a units place wheel for rotationally driving the units place display plate;

a tens place wheel for rotationally driving the tens place display plate, the tens place wheel being driven by the units place wheel so that the tens place wheel is unlocked by for one tooth by the units place wheel when the date shifts from a 9th day to a 10th day, from a 19th day to a 20th day and from a 29th day to a 30th day; and a program wheel that performs one revolution in 31 days by being unlocked every day by a predetermined angle by a date indicator driving wheel, the program wheel being programmed so that from a 1st day to a 31st day, the units place wheel is unlocked by for one tooth every day so that the units place wheel performs one revolution in 10 days, and so that when the date shifts from the 31st day to 1st day, the units place wheel is retained to a position of the 31st day and the tens place wheel is unlocked by for one tooth to thereby display the 1st day.

2. A date display mechanism according to claim 1; wherein the program wheel comprises a first stage having 30 internal teeth for unlocking the units place wheel and an interval portion without an internal tooth, and a second stage having one driving internal tooth for driving the tens place wheel.

3. A date display mechanism according to claim 2; wherein the 30 internal teeth and the interval portion of the first stage of the program wheel are equally angularly spaced relative one another.

4. A date display mechanism according to claim 3; further comprising a driving wheel interposed between the tens place wheel and the driving internal tooth of the program wheel for transmitting a driving force from the driving internal tooth to the tens place wheel.

5. A date display mechanism according to claim 2; further comprising a driving wheel interposed between the tens place wheel and the driving internal tooth of the program wheel for transmitting a driving force from the driving internal tooth to the tens place wheel.

6. A date display mechanism according to claim 1; wherein the date display window is disposed in a 12 o'clock position, the units place display plate is formed monolithically with a surface of the units place wheel, and the tens place display plate is formed in a surface of the tens place wheel.

7. A date display mechanism according to claim 1; wherein the date display window is disposed in a 12 o'clock position, the units place display plate has a larger diameter than and is disposed coaxially with the units place wheel, and the tens place display plate has a larger diameter than and is disposed coaxially with the tens place wheel.

8. A date display mechanism according to claim 7; wherein the tens place wheel meshes with the units place wheel through an intermediate wheel.

9. A timepiece having a date display mechanism according to claim 1.

10. A date display mechanism according to claim 1; wherein the program wheel comprises an annular ring.

11. A date display mechanism according to claim 10; wherein the annular ring is circular-shaped.

12. A date display mechanism according to claim 11; wherein the program wheel has 31 internal teeth.

13. A date display mechanism according to claim 1; wherein the program wheel has 31 internal teeth.

14. A date display mechanism according to claim 1; wherein the date display window is disposed in a 3 o'clock position, the units place display plate is formed monolithically with a surface of the units place wheel, and the tens place display plate and the tens place wheel are disposed coaxially with the program wheel.

15. A date display mechanism according to claim 1; wherein the date display window is disposed in a 3 o'clock position, the units place display plate is separate and independent from and integrally connected to the units place wheel, and the tens place display plate and the tens place wheel are disposed coaxially with the program wheel.

16. A date display mechanism according to claim 1; wherein each of the date display window and the tens place display plate is disposed in a 3 o'clock position, the units place display plate is formed monolithically with a surface of the units place wheel, and the tens place display plate has a larger diameter than the tens place wheel.

17. A date display mechanism according to claim 1; wherein each of the date display window and the tens place display plate is disposed in a 3 o'clock position, the units place display plate is separate and independent from and integrally connected to the units place wheel, and the tens place display plate has a larger diameter than the tens place wheel.

18. A date display mechanism according to claim 1; wherein the tens place wheel has a toothing for meshing engagement with a toothing of the units place wheel.

19. A date display mechanism comprising:

a date display window for displaying places of units and tens among dates from a 1st day to a 31st day;

a first date indicator having a display face containing numerals corresponding to the places of units displayed by the date display window;

a first driving wheel that rotationally drives the first date indicator, the first driving wheel having a toothing;

a second date indicator having a display face containing numerals corresponding to the places of tens displayed by the date display window;

a second driving wheel that rotationally drives the second date indicator, the second driving wheel having a toothing for meshing engagement with the toothing of the first driving wheel to cause the second driving wheel to rotate by one tooth when the date shifts from a 9th day to a 10th day, from a 19th day to a 20th day, and from a 29th day to a 30th day; and a program wheel that performs one revolution in 31days and that controls rotation of the first date indicator and the second date indicator so that from the 1st day to the 31st day, the first date indicator is rotated by one tooth every day, and so that when the date shifts from the 31st day to 1st day, the first date indicator is retained to a position of the 31st day and the second date indicator is rotated by one tooth to thereby cause the 1st day to be displayed by the date display window.

20. A date display mechanism according to claim 19; wherein the numerals contained in the display face of the first date indicator are "0", "1", "2", "3", "4","5", "6", "7", "8", and "9"; wherein the numerals contained in the display face of the second date indicator are "0", "1", "2", "3", "0", "1", "2", and "3"; and wherein, the program wheel has a display face containing 31 numerals of 1 through 31 .

21. A date display mechanism according to claim 19; further comprising a first jumper for setting a position of the first driving wheel in a rotation direction, a second jumper for setting a position of the second driving wheel in a rotation direction, and a third jumper for setting a position of the program wheel in a rotation direction.

22. A timepiece having a date display mechanism according to claim 19.

23. A date display mechanism according to claim 19; wherein the date display window is disposed in a 12 o'clock position, the first date indicator is formed monolithically with a surface of the first driving wheel, and the second date indicator is formed in a surface of the second driving wheel.

24. A date display mechanism according to claim 19; wherein the date display window is disposed in a 12 o'clock position, the first date indicator has a larger diameter than and is disposed coaxially with the first driving wheel, and the second date indicator has a larger diameter than and is disposed coaxially with the second driving wheel.

25. A date display mechanism according to claim 19; wherein the program wheel comprises an annular ring.

26. A date display mechanism according to claim 25; wherein the annular ring is circular-shaped.

27. A date display mechanism according to claim 25; wherein the program wheel has 31 internal teeth.

28. A date display mechanism according to claim 19; wherein the program wheel has 31 internal teeth.

29. A date display mechanism according to claim 19; wherein the date display window is disposed in a 12 o'clock position, the first date indicator is separate and independent from and integrally connected to the first driving wheel, and the second date indicator is formed in a surface of the second driving wheel.

30. A date display mechanism according to claim 19; wherein the program wheel comprises a first stage having 30 internal teeth for meshing engagement with the toothing of the first driving wheel and an interval portion without an internal tooth, and a second stage having one driving internal tooth for meshing engagement with the toothing of the second driving wheel through an intermediate driving wheel.

* * * * *